United States Patent [19]

Franssen

[11] 4,084,471

[45] Apr. 18, 1978

[54] CIRCUIT ARRANGEMENT FOR OBTAINING A CHORUS EFFECT

[75] Inventor: Nico Valentinus Franssen, Eindhoven, Netherlands

[73] Assignee: U.S. Philips Corporation, New York, N.Y.

[21] Appl. No.: 672,131

[22] Filed: Mar. 31, 1976

[30] Foreign Application Priority Data

Apr. 9, 1975 Netherlands ..... 7504203

[51] Int. Cl.[2] ..... G10H 1/00

[52] U.S. Cl. ..... 84/1.01; 84/1.24; 84/1.25

[58] Field of Search ..... 331/45, 60, 108 B, 135; 84/1.01, 1.24, 1.25, DIG. 4; 332/16 R; 307/262, 293; 328/55

[56] References Cited

U.S. PATENT DOCUMENTS

| | | | |
|---|---|---|---|
| 3,617,901 | 11/1971 | Franssen | 84/1.01 X |
| 3,816,635 | 6/1974 | Uetrecht | 84/1.01 |
| 3,828,109 | 8/1974 | Morez | 84/DIG. 4 X |
| 3,840,689 | 10/1974 | Nakada | 84/1.24 X |
| 3,866,505 | 2/1975 | Adachi | 84/1.24 |
| 3,916,752 | 11/1975 | Kawamoto et al. | 84/1.25 X |
| 3,962,947 | 6/1976 | Michel | 84/1.25 X |

*Primary Examiner*—Ulysses Weldon

*Attorney, Agent, or Firm*—Frank R. Trifari; Steven R. Biren

[57] ABSTRACT

A circuit arrangement for generating the tones of a tonal scale includes a master oscillator and a number of sets of frequency converters. The output signals of each set of frequency converters forms each of the tones of an octave. A frequency shifter is connected between at least one selected set of frequency converters and the master oscillator in order to shift the frequency supplied to the selected set of frequency converters from the master oscillator to cause a desired shift in the frequency of each of the tones of the octave produced by the selected set of frequency converters.

4 Claims, 5 Drawing Figures

Figure 1:
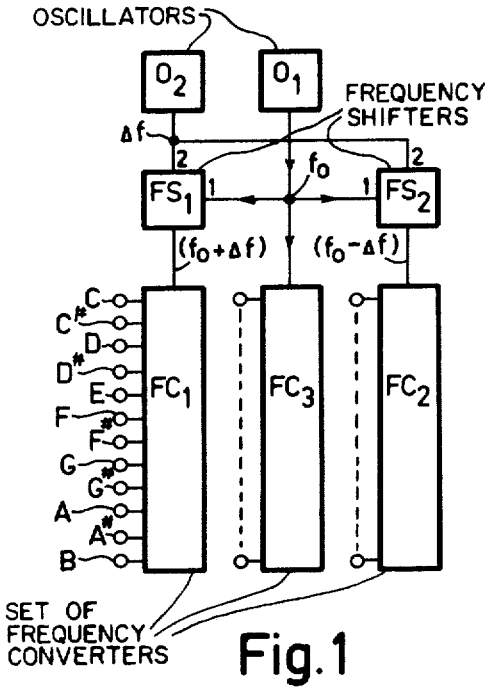

| a | b | c | n |
|---|---|---|---|
| 0 | 0 | 0 | 0 |
| 1 | 0 | 0 | 1 |
| 0 | 1 | 0 | 2 |
| 1 | 1 | 0 | 3 |
| 0 | 0 | 1 | 4 |
| 1 | 0 | 1 | 5 |
| 0 | 1 | 1 | 6 |
| 1 | 1 | 1 | 7 |
| 0 | 1 | 1 | 6 |
| 1 | 0 | 1 | 5 |
| 0 | 0 | 1 | 4 |
| 1 | 1 | 0 | 3 |
| 0 | 1 | 0 | 2 |
| 1 | 0 | 0 | 1 |
| 0 | 0 | 0 | 0 |

CIRCUIT ARRANGEMENT FOR OBTAINING A CHORUS EFFECT

The invention relates to a circuit arrangement for generating the tones of a tonal scale, preferably for electronic musical instruments, and is provided with one master oscillator and a set of frequency converters which are coupled thereto, the output signals of the frequency converters, as the case may be, together with the output signal of the master oscillator, forming the tones of an octave.

Such a circuit arrangement is known from German Patent Specification No. 1,213,210. In this circuit arrangement the signal from the master oscillator is divided by an integer in a frequency divider for each tone of the octave, the dividends being selected so that the twelve tones of the octave are available with sufficiently accurate frequency at the outputs of the twelve frequency dividers.

In another known circuit arrangement described in Netherlands Patent Specification No. 142,804 the frequency of the master oscillator is divided in a divider chain and for each tone of the octave the outputs of said dividers are connected to a gate circuit whose output pulse trains yield the desired tone at the output of the gate circuit. From Netherlands Patent Application No. 71 09 138 it is also known to apply the frequency of the master oscillator to a frequency converter, the next lower tone of the scale being obtained at an output of said converter, which tone is applied to the input of a subsequent frequency converter.

In order to obtain a richer sound the signals may be frequency-modulated in a low frequency rhythm of for example 7 Hz, so that a vibrato is obtained. To obtain the chorus effect known from pipe organs and other musical instruments such as accordions, which effect occurs when different pipes or tongues are not equally tuned, either on purpose or unintentionally, such a vibrato is inadequate.

It is an object of the invention to obtain this chorus effect in a better manner.

For this purpose, in accordance with the invention, at least two sets of frequency converters are provided and between at least one set of frequency converters and the oscillator there is included a frequency shifter which shifts the frequency of the master oscillator by a number of cents, which shift may be adjustable.

In this respect a cent is to be understood to mean one hundredth of a semitone interval, which in the case of an equal-tempered scale equals $2^{1/1200}$ 1.00057779.

Each set of frequency converters forms a chorus. The frequency shift, i.e. the chorus detuning, relative to the nominal frequency may be from 0 to approximately 25 cents, as required.

In accordance with a different embodiment of the invention there is provided for each mutation or harmonic a frequency shifter and a set of frequency converters, pure mutations or harmonics being available at the outputs of the frequency converters owing to the frequency shift.

As a result of this, it is possible to use the pure fifth, third, seventh etc. as filling voices instead of the equal-tempered, so that pure harmonics are obtained. This is of importance for both organs which operate in accordance with the so-called analysis principle, the harmonics of the composite voltages or currents such as the commonly used sawtooth voltage or squarewave voltage being naturally pure and dissonating with the equal-tempered filling voices, and for organs in accordance with the synthesis system where each tone is derived from a substantially sinusoidal fundamental and substantially sinusoidal harmonics, so that the desired sounds can be imitated in a more satisfactory manner.

In still a different embodiment of a circuit arrangement in accordance with the invention at least one device is provided for periodically or statistically varying the frequency shift of the frequency shifter. Thus, in addition to the chorus effect, a regular or irregular vibrato is obtained which adds to the chorus effect.

A further improvement is achieved if in accordance with a further embodiment of a circuit arrangement according to the invention the frequency shift and/or the frequency shift variation by each frequency shifter and/or devices is independent of that of the other device.

In a circuit arrangement in accordance with the invention a frequency shifter comprises a first phase shifter to whose input the signal from the master oscillator is applied, the signals at the first and second outputs have a mutual phase shift of 90°, the first output being connected to the first input of a first frequency multiplier and the second output to a first input of a second frequency multiplier, whilst a second phase shifter is provided to whose input a signal with a frequency equal to the desired frequency shift is applied, the signals at a first and second output of which have a mutual phase shift of 90°, the first output leading to the second input of the first frequency multiplier and the second output to the second input of the second frequency multiplier, and the output of the first and the second frequency multiplier respectively being connected to a first and a second input respectively of an adder circuit and/or to a first and a second input respectively of a subtractor circuit.

Thus, two signals are obtained whose frequency is shifted by the same amount relative to the frequency of the master oscillator but in opposite directions, the frequency of the master oscillator determining the eventual pitch.

In a different circuit arrangement in accordance with the invention the frequency shifter comprises a blocking circuit provided with a first input to which a pulse train to be shifted in frequency is applied and a second input to which a pulse train with a frequency equal to the desired frequency shift is applied, each pulse at the second input suppressing one pulse of the pulse train at the first input.

Such circuit arrangements are known per se from Netherlands Patent Specification No. 143,713 and are in particular suitable for digital techniques.

As in general the pitch is substantially determined by the average frequency of the choruses, the pitch in the case of an odd number of choruses will be determined by the output frequency of the blocking circuit which supplies the average frequency, and no longer by the master oscillator, because blocking circuits can only supply signals whose frequency is lower than that of the input signal.

In a further circuit arrangement in accordance with the invention a first divider is provided whose input receives the signal whose frequency is to be shifted and whose output, at which a signal having a frequency equal to the desired frequency shift is available, both lead to a second divider whose dividend can be adjusted at option, and to a first input of a first blocking circuit of which a second input to which the blocking signal is applied is connected to a first output of a third divider whose input is connected to the output of the second divider, which third divider comprises a number of divider stages at whose outputs pulse trains appear whose pulses do not coincide, and an adder circuit whose inputs are each connected to an output of the divider stages and at whose output a signal appears with the sum frequency of the signals at the inputs and whose output leads to a first output of the third divider, whilst the output of the divider stages are each connected to a first input of a gate circuit whose second inputs are each connected to an output of a reversible counter and whose output leads to a further gate circuit at whose output a signal appears with a frequency equal to the sum of the frequencies of the signals at the inputs, whilst the frequency of the counting cycles of the counter is equal to the desired vibrato frequency, which counter is provided with a control input to which a control signal can be applied and, as the case may be, with further inputs for blocking the counter in a specific position, and an input for reversing the counting direction, the output of the first blocking circuit leading to a second input of a second blocking circuit to whose first input the signal whose frequency is to be shifted is also applied and whose output is connected to the first input of a third blocking circuit, whose output is connected to the first input of a fourth blocking circuit at whose output the desired signal is available, whilst the second inputs of the third and the fourth blocking circuit lead to the output of the further gate circuit.

Figure 2:
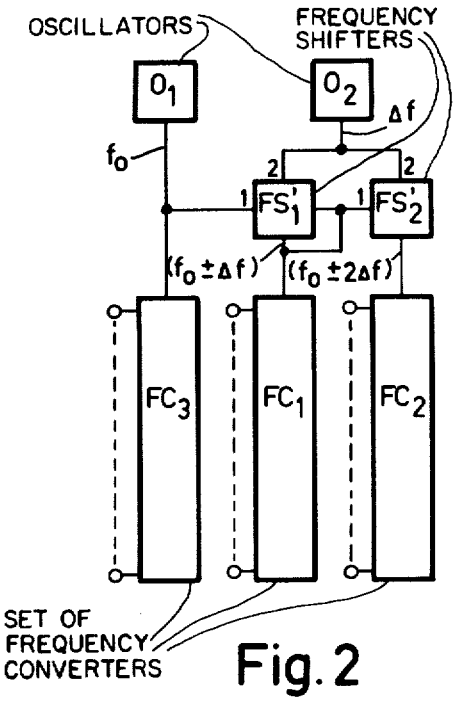
Figure 3:
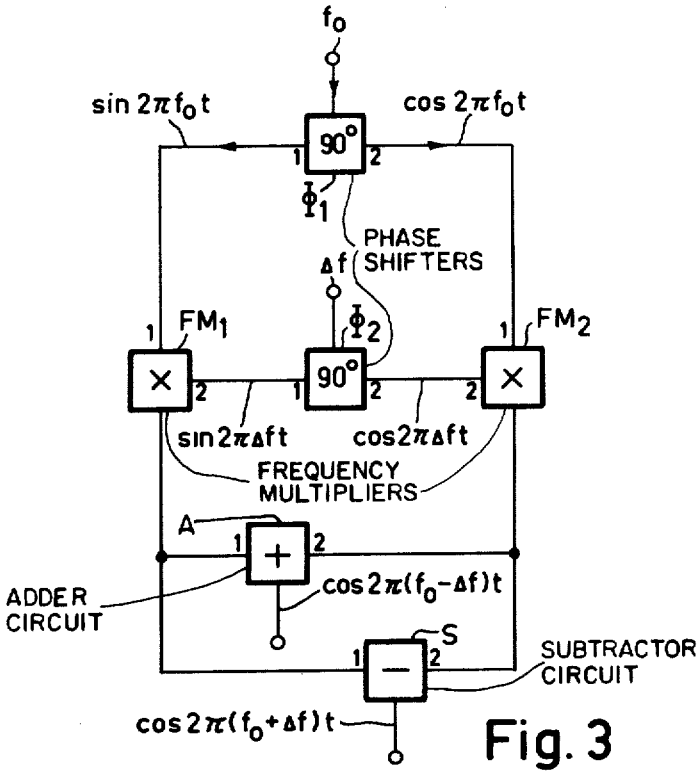
Figure 4:
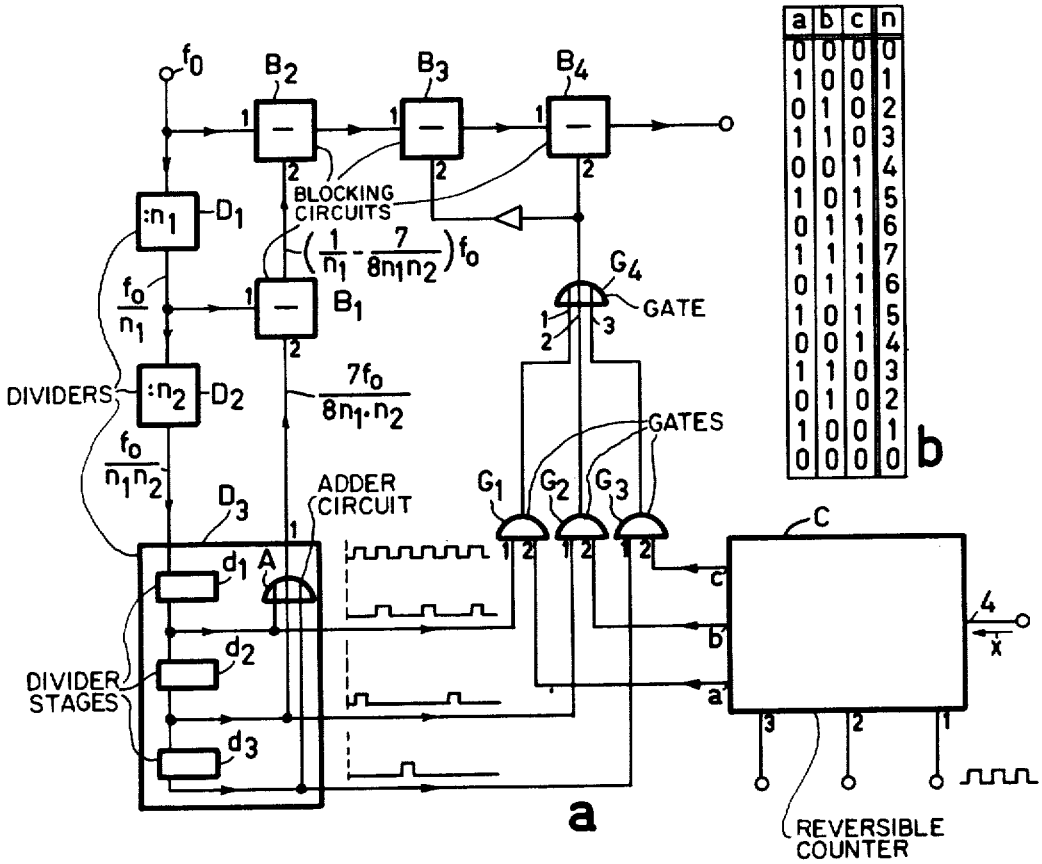
Figure 5:
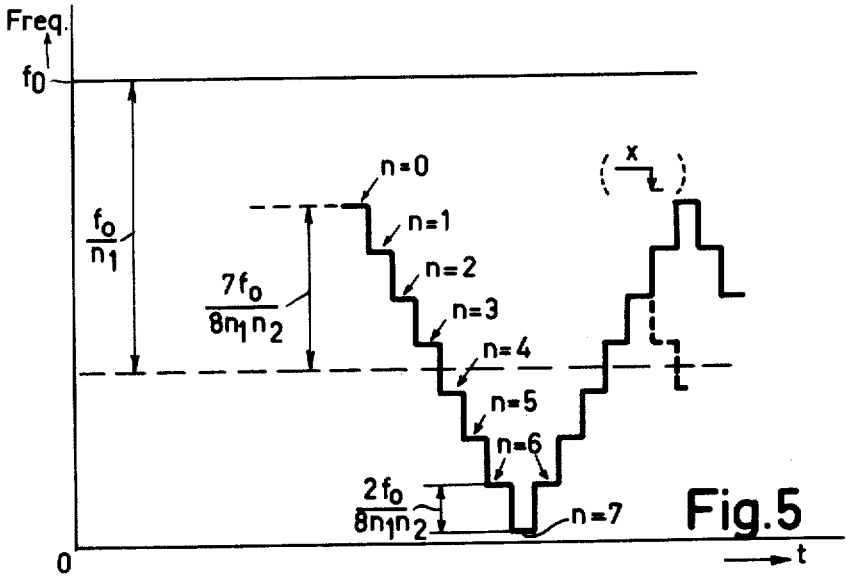

The invention will now be described in more detail with reference to the drawing, in which FIG. 1 shows a circuit arrangement provided with frequency shifters which shift the frequency of the input signal both upwards and downwards, FIG. 2 shows a circuit arrangement provided with frequency shifters which may take the form of blocking circuits, FIG. 3 shows further details of the frequency shifters of FIG. 1, FIG. 4*a* shows a frequency shifting circuit with vibrato, FIG. 4*b* shows the truth table of the reversible counter, FIG. 5 shows a graph of the associated frequency variation.

FIG. 1 shows how the output signal of a master oscillator $O_1$ is applied to a first input 1 of a frequency shifter $FS_1$, which shifts the frequency of the output signal upwards by an amount $\Delta f$. For this purpose a second oscillator $O_2$, which supplies a signal with a frequency $\Delta f$ equal to the desired frequency shift, is connected to a second input 2 of the frequency shifter $FS_1$. At the output of this frequency shifter $FS_1$, a signal is then obtained whose output frequency equals $f_o + \Delta f$. This output signal is applied to an input of a set of frequency converters $FC_1$ whose tones form the tones of an octave at the outputs. By taking a second frequency shifter $FS_2$, which shifts the output frequency of the master oscillator $O_1$ downwards, a signal with an output frequency $f_o - \Delta f$ is obtained at the output of said frequency shifter $FS_2$, which signal is applied to an input of a set of frequency converters $FC_2$. By also applying the output frequency of the master oscillator $O_1$ directly to a set of frequency converters $FC_3$, three choruses are obtained two of which are detuned relative to the central frequency $f_o$.

In FIG. 2 the master oscillator is connected both to the input of a set of frequency converters $FC_3$ and to the first input of a first frequency shifter $FS_1'$, whose second input is connected to the second oscillator $O_2$ which supplies a signal with a frequency $\Delta f$ equal to the desired frequency shift. At the output of the frequency shifter $FS_1'$, which is connected to the first input 1 of the second frequency shifter a signal occurs having a frequency $(f_o + \Delta f)$ or $(f_o - \Delta f)$, depending of the type of frequency shifter. The second input of the second frequency shifter $FS_2'$ is connected to the second oscillator $O_2$, so that at the output a signal is available whose frequency equals $(f_o + 2\,\Delta f)$ or $(f_o - 2\,\Delta f)$, depending on the selected type of frequency shifter. The outputs of the frequency shifters $FS_1'$ and $FS_2'$ are each connected to a set of frequency converters $FC_1$ and $FC_2$ respectively. Thus, three choruses are obtained, but in this case the average frequency equals that of the chorus whose frequency shift relative to the master oscillator O is smaller. Such a frequency shifter may take the form of a blocking circuit, which is known per se from Netherlands Patent Specification No. 147,713, FIGS. 1 and 3. In these circuits it is only possible to obtain a frequency shift in a negative sense, so that the frequency shifts will be $(f_o - \Delta f)$ and $(f_o - 2\,\Delta f)$ respectively. It will be evident that in the examples of FIG. 1 and FIG. 2 it is not necessary to connect the two frequency shifters to the same oscillator, but that it is alternatively possible to employ two oscillators with slightly different frequencies. This enlivens the chorus effect, which is also the case when the frequency of the second oscillator or oscillators is varied either periodically, so that a vibrato occurs, or statistically so that the choruses may vary in frequency independently of each other, as in practice is the case with pipe organs.

The circuit arrangements of FIG. 1 and FIG. 2 may also be employed to obtain pure filling voices or harmonics. For this purpose, for example, the pure fifth can be made with the circuit arrangement of FIG. 1 by multiplying the frequency at the input by 1.5/1.498307 or dividing it by 4/3. In the first case $\Delta f$ becomes $\Delta f = (1.5/1.498307 - 1) f_o$ and in the second case $\Delta f = (1 - 3/4) f_o = \frac{1}{4} f_o$.

FIG. 3 shows a possible embodiment of the frequency shifter of FIG. 1 in which by means of one circuit two output frequencies can be obtained, of which one frequency is shifted upwards by an amount $\Delta f$ and the other is shifted downwards by the same amount. The sinusoidal signal with the frequency $f_o$ from the master oscillator is applied to a first phase shifter $\phi_1$, of which the signals at the outputs 1 and 2 are 90° phase shifted relative to each other, so that at the one output 1 a signal appears which is proportional to $\sin 2\pi f_o t$ and at the other output 2 a signal proportional to $\cos 2\pi f_o t$. The first output 1 of the phase shifter $\phi_1$ is connected to a first input 1 of a first frequency multiplier $FM_1$ and the second output 2 to a first input 1 of a second frequency multiplier $FM_2$. A sinewave oscillator whose frequency equals the desired frequency shift $\Delta f$ is connected to a second phase shifter $\phi_2$ which at its first output 1 and its second output 2 also supplies two signals which are mutually 90° phase shifted, and which are proportional to $\sin 2\pi\Delta ft$ and $\cos 2\pi\Delta ft$. The outputs 1 and 2 of the phase shifter $\phi_2$ are connected to a second input 2 of the first and the second frequency multiplier $FM_1$ and $FM_2$ respectively. At the outputs of the frequency multiplier $FM_1$ a signal is then obtained which is proportional to $\sin 2\pi f_o t$, $\sin 2\pi\Delta ft$ and at the output of the frequency multiplier $FM_2$ a signal which is proportional to cos $2\pi f_o t$, cos $2\pi\Delta f t$. These signals are applied to the first input 1 and the second input 2 respectively of an adder circuit A at whose output a signal appears with a frequency which is proportional to cos $2\pi(f_o - \Delta f)\ t$. Moreover, these signals are applied to a first input 1 and a second input 2 respectively of a subtractor circuit S at whose output a signal appears whose frequency is proportional to cos $2\pi(f_o + \Delta f)t$. Consequently, signals are obtained at the output of the adder circuit A and the subtractor circuit S which are shifted by an amount $\Delta f$ relative to the frequency of the master oscillator. Obviously, it is possible to employ this circuit arrangement for the frequency shifters $FS_1'$ and $FS_2'$ of FIG. 2 by either dispensing with or not using the adder circuit A or the subtractor circuit S.

It may be advantageous to derive the signal with the frequency $\Delta f$ from the signal from the master oscillator by means of a frequency divider. This is particularly attractive for digitally operating circuits, because these circuits in the form of integrated circuits can be provided with such a divider at only a slight increase in cost. Such a circuit arrangement, which is moreover provided with a vibrato circuit, is shown in FIG. 4*a*, in which the frequency shift is obtained with the aid of blocking circuits.

The signal whose frequency is to be shifted by a frequency $f_o$ is applied to a first divider $D_1$ which divides the input frequency $f_o$ by a factor $n_1$ and whose output frequency $f_o/n_1$ equals the desired average frequency shift. This output leads both to a second divider $D_2$ whose dividend $n_2$ is adjustable and to a first input 1 of a first blocking circuit $B_1$ whose second input 2, to which the blocking signal is applied, is connected to a first output 1 of a third divider $D_3$, whose input is connected to the output of the second divider $D_2$. The third divider $D_3$ comprises a number of divider stages $d_1$, $d_2$ and $d_3$ which in the present example consist of divide-by-two circuits and at whose outputs pulse trains appear whose pulses do not coincide, as shown in the FIGURE. The outputs of these divider stages $d_1$, $d_2$ and $d_3$ are each connected to an input of an adder circuit A at whose output a signal appears with the sum frequency of the signals at the input, which sum frequency consequently equals:

$$(7f_o)/(8n_1 \cdot n_2)\ .$$

Moreover, the outputs of the divider stages $d_1$, $d_2$ and $d_3$ are each connected to a first input 1 of a gate circuit $G_1$, $G_2$ and $G_3$ respectively, whose second inputs are each connected to an output *a*, *b* and *c* of a reversible counter C, which in the present instance takes the form of an 8-position counter, whilst the output of each gate circuit $G_1$, $G_2$ and $G_3$ leads to a corresponding input 1, 2 and 3 respectively of a further gate circuit $G_4$ at whose output a signal appears with a frequency equal to the sum of the frequencies of the signals at the inputs, the frequency of the counting cycles of the counter being equal to the desired vibrato frequency. This sum is $$(n \cdot f_o)/(8n_1 \cdot n_2)$$

the value of $n$ being 0–7 depending on the counter position. The counter C, whose truth table is shown in FIG. 4*b*, is provided with a control input 1 to which a control signal may be applied. The frequency of this control signal equals the product of the number of steps per counting cycle and the desired vibrato frequency. Moreover, the counter comprises two further inputs 2 and 3 respectively for blocking the counter in the specific position, and an input 4 for reversing the counting direction. The output of the first blocking circuit $B_1$ is connected to a second input 2 of a second blocking circuit $B_2$, to whose first input the signal $f_o$ whose frequency is to be shifted is also applied, and whose output is connected to the first input 1 of a third blocking circuit $B_3$ whose output is connected to the first input of a fourth blocking circuit $B_4$ at whose output the desired signal is available. The second inputs of the third and fourth blocking circuit $B_3$ and $B_4$ respectively are connected to the output of the further gate circuit $G_4$.

The possibilities of this circuit arrangement which will be described with reference to FIG. 5, are the following:

a. The counter C is blocked in its first position $n = 0$. The signals from the dividing stages $d_1$, $d_2$ and $d_3$ of the counter $D_3$ are not transferred by the gate circuits $G_1$, $G_2$ and $G_3$, so that the signals at the inputs of the third and fourth blocking circuit $B_3$ and $B_4$ respectively are transferred unimpededly, i.e. that at the output of the fourth blocking circuit $B_4$ a signal appears which is equal to $$(1 - \frac{1}{n_1} + \frac{7}{8n_1n_2})f_o$$

This is the position in which the frequency shift is minimal.

b. The counter C is blocked in the position $n = 7$. All signals from the divider stages $d_1$, $d_2$ and $d_3$ of the third divider $D_3$ are then transferred by the gate circuits $G_1$, $G_2$ and $G_3$, so that at the output of the further gate circuit $G_4$ a signal appears with a frequency $(7)/(8n_1n_2)$ $f_o$. This pulse train is subtracted from the signal at the output of the second blocking circuit $B_2$ both in the third blocking circuit $B_3$ and in the fourth blocking circuit $B_4$, so that the frequency equals $$(1 - \frac{1}{n_1} - \frac{7}{8n_1n_2})f_o$$

Consequently, the maximum frequency shift is obtained.

c. When the counter is stopped in an arbitrary intermediate position an intermediate frequency shift may be selected by the choice of this position. Stopping is possible by giving the counter the selected position in the usual manner (pre-setting).

d. When the counter C is made to count up and down regularly by applying a regular pulse train to the control input 1, a regular vibrato is obtained because then a frequency appears at the output of the further gate circuit $G_4$ which varies from 0 to $7f_o$. In FIG. 5 this is represented by the stepped curve.

e. In order to give the chorus effect a statistical character as occurs in practice, a signal $x$ may be applied to the fourth input 4 of the counter C at arbitrary instants, which signal causes the direction of the counter C to be reversed at that instant. In FIG. 5 this is indicated by the dashed stepped curve.

It will be evident that the number of steps of the counter C may be selected arbitrarily, whilst it is obvious that the number of divider stages of the divider $D_3$ must be adapted to this.

By varying the dividend $n_1$ the average frequency shift can be changed, whilst the detuning per step and the vibrato depth are determined by the product of the dividends $n_1 \cdot n_2$ of the dividers $D_1$ and $D_2$.

The signals at the outputs of the various sets of frequency converters may be reproduced via a common amplifier and loudspeaker, but preferably each chorus is connected to a separate loudspeaker.

What is claimed is:

1. A circuit arrangement for generating the tones of a tonal scale, comprising:

a master oscillator and a plurality of sets of frequency converters coupled thereto, the output signals of each set of frequency converters forming each of the tones of an octave;

a first frequency shifter connected between at least one selected set of frequency converters and the master oscillator which shifts the frequency supplied to said selected set of frequency converters from said master oscillator by a selectable number of cents, for producing a predetermined shift in the frequency of each of the tones of the octave produced by said selected set of frequency converters, said frequency shifter comprising a first phase shifter having an input to which the signal from the master oscillator is applied, and first and second outputs which are 90° phase shifted relative to each other, and a second phase shifter having an input to which a signal with a frequency equal to the desired frequency shift is applied, and first and second outputs which are 90° phase shifted relative to each other;

first and second frequency multipliers, the first multiplier having a first input connected to the first output of the first phase shifter, a second input connected to the first output of the second phase shifter and an output; the second frequency multiplier having a first input connected to said second output of said first phase shifter, a second input connected to the second output of the second frequency multiplier and an output; and an adder circuit and a subtractor circuit, the outputs of the first and the second frequency multipliers each being connected respectively to a first and a second input of the adder circuit and to a first and second input of the subtractor circuit.

2. A circuit arrangement as claimed in claim 1, further comprising a second frequency shifter and a corresponding set of frequency converters for each desired shift in frequency of each of the tones of an octave, each said shift in frequency being selected to provide pure harmonics at the outputs of the frequency converters.

3. A circuit arrangement as claimed in claim 1, wherein the elements of said circuit are accommodated on a substrate of semiconductor material.

4. A circuit arrangement for generating the tones of a tonal scale, comprising:

means for supplying a signal of a predetermined frequency;

a first divider having an input connected to said means for supplying a signal, and an output at which a signal of a frequency equal to the desired frequency shift is produced, a second divider with an adjustable dividend, having an input connected to the output of said first divider, and an output;

a first blocking circuit having a first input connected to the output of said first divider, a second input to which a blocking signal may be applied, and an output;

a third divider comprising a plurality of divider stages having an input connected to the output of said second divider, and a plurality of outputs on which non-coincidental pulse trains are generated, and adder means having inputs connected to corresponding outputs of said divider stages and an output on which a signal having the sum frequency of the signals on said inputs is generated, said output being connected to said second input of said first blocking circuit;

a multiple gate circuit having a plurality of first inputs connected to corresponding outputs of said divider stages, second inputs, and an output on which a signal having the sum frequency of the signals on said inputs is generated;

a reversible counter having a control input, an input for blocking the counter in a predetermined position, an input for reversing the counter direction, and a plurality of outputs connected to corresponding second inputs of said multiple gate circuit, the frequency of the counting cycles of the counter being equal to a predetermined vibrato frequency;

a second blocking circuit having a first input connected to said means for supplying a signal, a second input connected to said output of said first blocking circuit, and an output;

a third blocking circuit having a first input connected to said output of said second blocking circuit, a second input connected to said output of said multiple gate circuit, and an output; and a fourth blocking circuit having a first input connected to said output of said third blocking circuit, a second input connected to said output of said multiple gate circuit, and an output for producing the desired output signal.

* * * * *